US006636403B2

(12) United States Patent
McLoughlin et al.

(10) Patent No.: US 6,636,403 B2
(45) Date of Patent: Oct. 21, 2003

(54) THERMALLY PROTECTED METAL OXIDE VARISTOR

(75) Inventors: Neil A. McLoughlin, Blackrock (IE); Michael O'Donovan, Dundalk (IE)

(73) Assignee: Littlefuse Ireland Development Company Limited (IE)

( * ) Notice: Subject to any disclaimer, the term of this patent is extended or adjusted under 35 U.S.C. 154(b) by 323 days.

(21) Appl. No.: 09/843,272

(22) Filed: Apr. 26, 2001

(65) Prior Publication Data

US 2001/0055187 A1 Dec. 27, 2001

(30) Foreign Application Priority Data

Apr. 26, 2000 (EP) ..... 00650040
Mar. 9, 2001 (IE) ..... 010227

(51) Int. Cl.[7] ..... H02H 3/08
(52) U.S. Cl. ..... 361/103; 361/127; 337/5
(58) Field of Search ..... 361/127, 103; 337/5

(56) References Cited

U.S. PATENT DOCUMENTS 5,404,126 A 4/1995 Kasai et al.
5,708,553 A 1/1998 Hung
5,781,394 A 7/1998 Lorenz et al.
5,901,027 A 5/1999 Ziegler et al.
6,252,488 B1 * 6/2001 Ziegler et al. ..... 337/5

FOREIGN PATENT DOCUMENTS

DE 3734214 A1 4/1989
WO WO 98/25285 6/1998

* cited by examiner

*Primary Examiner*—Brian Sircus
*Assistant Examiner*—James A Demakis
(74) *Attorney, Agent, or Firm*—Bell, Boyd & Lloyd, LLC

(57) ABSTRACT

A varistor has a thermal fuse between a lead and an electrode. The fuse includes a link extending between the surface of an insulator and the fused electrode. The electrical connection of the link and the electrode is maintained by a low temperature solder fillet. That part of the link between the electrode and the insulator is surrounded by hot melt electrically insulating material. Upon sustained over-voltage conditions, the link and the solder fillet melt, and an insulating gap is rapidly created by molten hot melt material.

13 Claims, 3 Drawing Sheets

THERMALLY PROTECTED METAL OXIDE VARISTOR

BACKGROUND OF THE INVENTION

The present invention relates generally to a metal oxide varistor (MOV) of the type having an integral thermally activated fuse for protection. More specifically, the present invention relates to an MOV device having a fuse that causes the varistor to go open circuit in conditions of overheating due to sustained over-voltages.

One such device is described in U.S. Pat. No. 5,901,027 (Leviton), in which a flat thermal fusible layer is deposited on a MOV element. U.S. Pat. No. 5,708,553 (Hung) also describes such a varistor, in which a lead is spaced-apart from an electrode and is connected to it by a column of solder extending outwardly from the electrode.

While these varistors appear to be reasonably effective, there is scope for improving characteristics in such a device. One such improvement is provision of an improved insulation gap after fusing, without relying on properties such as outgassing in an epoxy. Another desirable improvement is better handling of transient peak currents. It is also desirable that manufacturing be simplified.

SUMMARY OF THE INVENTION

There is a need for an improved varistor device that provides integrated thermal protection.

To this end, in an embodiment, the present invention provides a thermally protected metal oxide varistor including a varistor body, a number of electrodes on the varistor body one of the electrodes being a fused electrode, a number of leads, and a fuse connecting a lead to the fused electrode. The fuse includes an insulator overlying part of the fused electrode; a link having a portion overlying the insulator and a portion electrically connected to the fused electrode, the link being of a material having a melting point at or below a thermal safety temperature threshold for the varistor; and a body of hot melt material in contact with the link, the hot melt material being an electrical insulator and having a melting point such that it melts and flows to create an insulating gap between the fused electrode and the material of the link when the link becomes molten.

In an embodiment, the link is of elongate wire shape.

In an embodiment, the link includes a solder material and internal flux within the solder material.

In an embodiment, the solder material is Sn/Pb.

In an embodiment, the flux is located centrally within the link.

In an embodiment, the hot melt material surrounds the link between the insulator and the fused electrode.

In an embodiment, the hot melt material is in contact with the fused electrode.

In an embodiment, a portion of the hot melt material lies between the fused electrode and the link.

In an embodiment, the link is electrically connected to the fused electrode by a low temperature solder fillet.

In an embodiment, the hot melt material acts to retain the link in position, so that the link has a stable position before encapsulation.

In another embodiment, the present invention provides a metal oxide varistor including a varistor body, electrodes including a fused electrode, leads, and a thermal fuse connecting a lead to the fused electrode. The fuse includes an insulator overlying part of the fused electrode; and a link of elongate shape and including flux surrounded by solder material having a melting point at or below a thermal safety temperature threshold for the varistor. The link further includes a first portion in contact with the fused electrode, a second portion surrounded by a body of hot melt material, said hot melt material also being in contact with the fused electrode, and a third portion overlying the insulator and being connected to a lead. The hot melt material is an electrical insulator and has a melting point such that it melts and flows to create an insulating gap between the fused electrode and the material of the link when the link becomes molten.

Accordingly, it is an advantage of the invention to provide a varistor that has integrated thermal protection to protect against damage due to sustained over-voltages.

Other features and advantages of the present invention will be described in and are apparent from the detailed description of the presently preferred embodiments.

DETAILED DESCRIPTION OF THE PRESENTLY PREFERRED EMBODIMENTS

Figure 1:
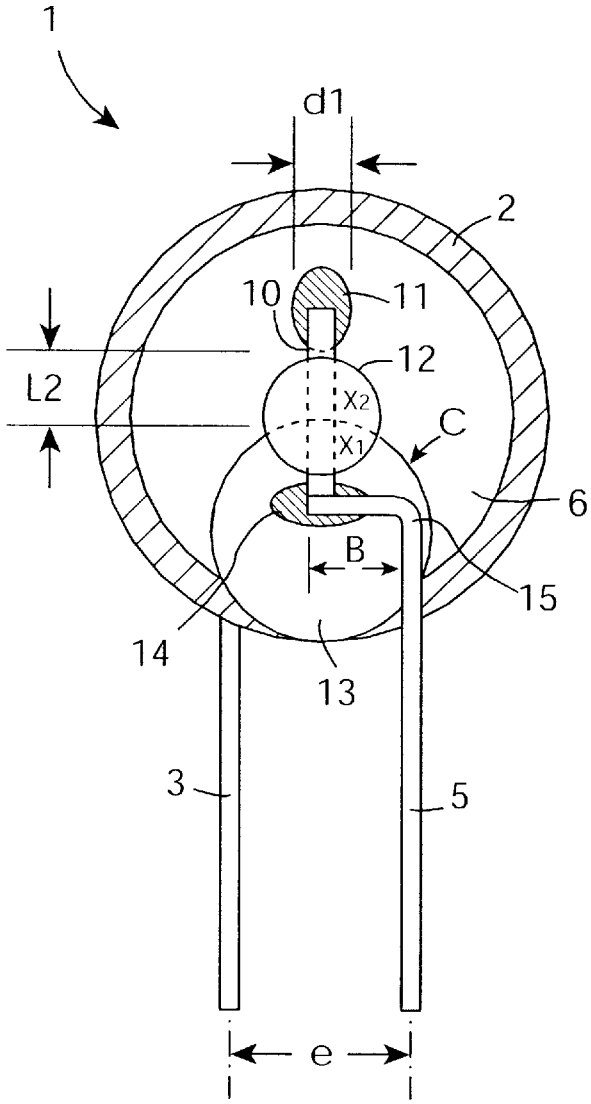
FIG. 1 illustrates a cross-sectional plan view of a varistor of the present invention.
Figure 2:
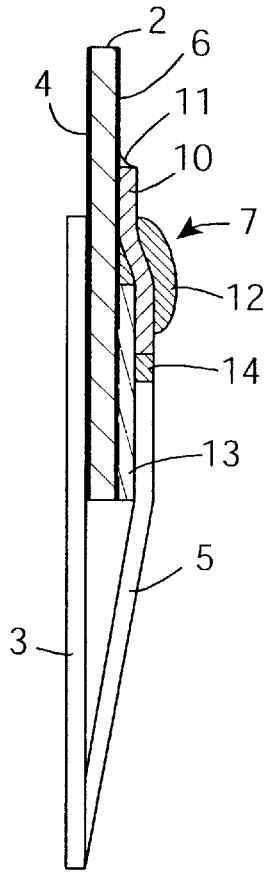
FIG. 2 illustrates a cross-sectional side view of the varistor of the present invention.

Referring to FIGS. 1 and 2, a varistor 1 includes a zinc oxide disc 2 for over-voltage protection. A lead 3 is connected to an electrode 4 on one side of the disc 2, and a lead 5 is connected to an electrode 6 on the other side via a thermal fuse 7. Thus, the electrode 6 is referred to as a "fused" electrode for the purposes of clarity.

The fuse 7 includes a wire link 10 of 60:40 w.w. Sn/Pb material with a fluxed core, having a relatively low melting point of c. 180° C. This is the primary active element of the fuse 7. The link 10 has a diameter of 1.2 mm, sufficient to handle peak pulses while also allowing effective disconnection under fuse conditions. The fluxed core runs centrally in a symmetrical pattern through the link 10.

The link 10 is soldered at a first portion to the fused electrode 6 by a low temperature solder fillet 11 of non-eutectic solder having a melting point in the region of 165° C. The fact that the solder fillet 11 has a slightly lower melting point than the link 10 allows relatively simple assembly in which application of the fillet 11 does not adversely affect the link 10.

A body of polyamide hot melt 12 surrounds the link 10 at a second portion where it is sloped at a small acute angle away from the fused electrode 6 to lie over an insulation disc 13 of alumina material. The hot melt 12 has a melting point of approximately 150° C. The hot melt material 12 is in contact with the fused electrode 6 below the link 10. In this specification, the term "hot melt" means any material which is an electrical insulator and which becomes molten at approximately the fusing temperature.

The arrangement of the hot melt material 12 is such that it lies on part of the fused electrode 6 as illustrated, and it surrounds the link 10 where it is ramped away from the electrode 6.

At a third portion, the link 10 is soldered to the varistor lead 5 by a low temperature solder fillet of the same material as the fillet 11. The link 10 may alternatively be connected to the lead 5 by heating the end of the lead 5, causing the link 10 to melt locally at its inner end and adhere to the lead 5. The lead 5 has a right angled bend over the insulator 13.

Finally, the varistor 1 comprises an encapsulant of conventional epoxy material, providing an external diameter dimension such as 14 mm or 20 mm.

The following are parameter values, with reference to FIG. 1.

All dimensions in mm

| FIG. 1 Notation | Parameter | 14 mm Dia. Varistor | 20 mm Dia. Varistor |
|---|---|---|---|
| e | Lead Spacing | 7.5 ± 1.0 | 7.5 ± 1.0 |
| B | Bend Distance | 5.3 ± 1.3 | 5.3 ± 1.3 |
| C | Insulation Diameter | 7.0 ± 1.0 | 10.0 ± 1.0 |
| Xl | Hotmelt Overlap on Insulation | 3 mm | 3 mm |
| X2 | Hotmelt Overlap on Electrode | 3 mm | 3 mm |
| D1 | Solder Fillet Width | 3.9 ± 1.9 | 4.5 ± 2.6 |
| L2 | Fusing Distance | 3.5 ± 2.1 | 4.1 ± 1.5 |

Figure 3:
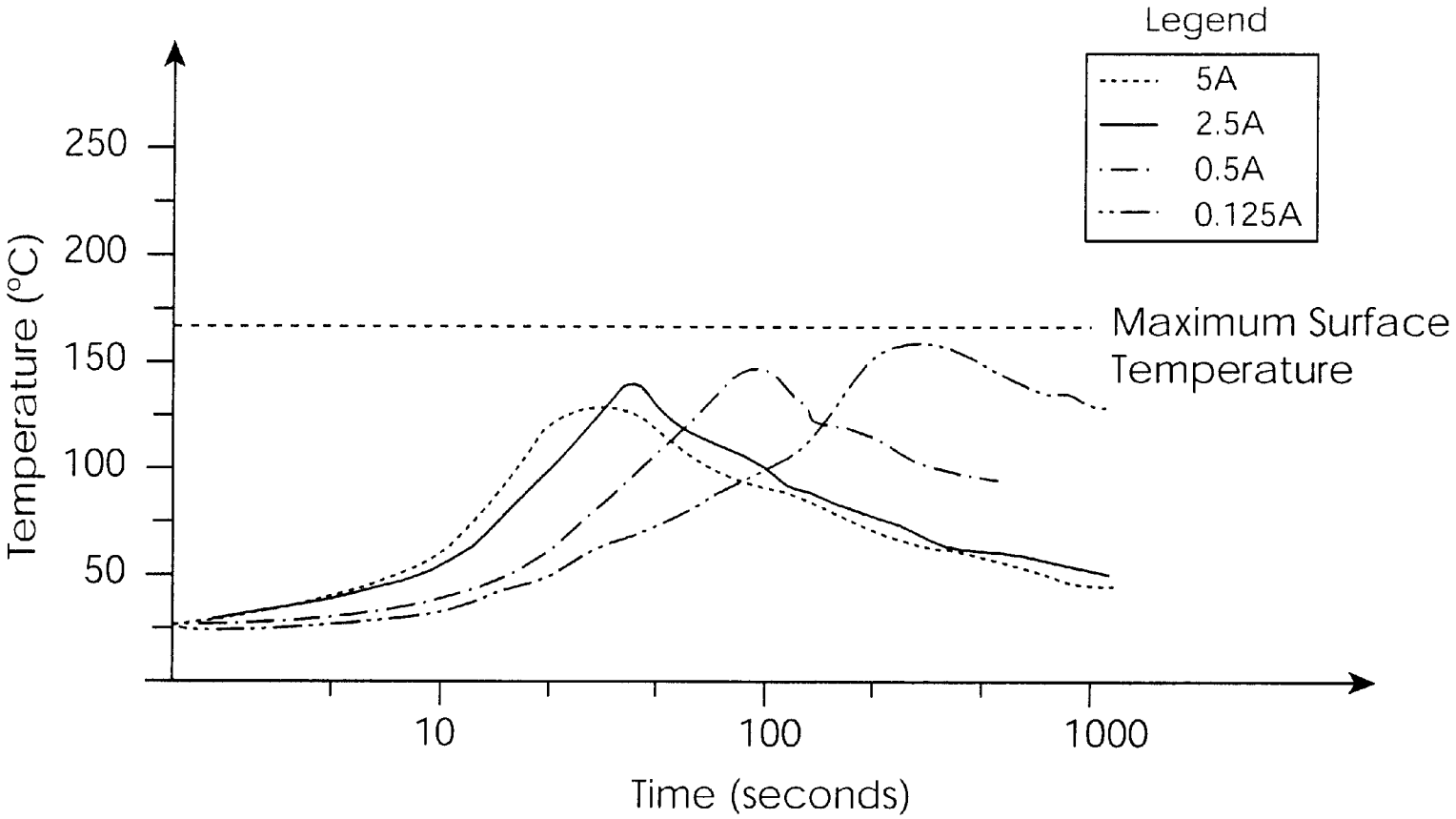
FIG. 3 illustrates a plot of representative temperature of points on the external surface of the varistor versus time.

The varistor 1 operates as a surge suppressor meeting the requirements of the UL 1449 and other standards and guidelines. The fuse 7 provides integrated thermal protection which open-circuits the varistor 1 in the event of overheating due to sustained over-voltages. This protection prevents fire, fragmentation, and scorching when abnormal sustained over-voltages occur. Referring to FIG. 3, plots for encapsulant surface temperature during abnormal over-voltage limited currents of 0.125 A, 0.5 A, 2.5 A, and 5 A are illustrated. It will be appreciated that the surface temperature does not exceed c.170° C.

The following are the ratings for the varistor 1.

| Condition | Value | Units |
|---|---|---|
| Continuous: | | |
| Steady State Applied Voltage: | V | |
| AC Voltage Range ($V_{M(AC)RMS}$) | | |
| Transient: | | |
| Peak Pulse Current (ITM) For 8/20 μs Current Wave, single pulse | 6000 to 100000 | A |
| Single Pulse Energy Capability For 10/1000 μs Current Wave | 50 to 273 | J |
| Operating Ambient Temperature range ($T_A$) | −55 to +85 | ° C. |
| Storage Temperature ($T_{STG}$) | −55 to +125 | ° C. |
| Temperature Coefficient (αV) of Clamping Voltage ($V_C$) at Specified Test Current | <0.01 | %/° C. |
| Hi-Pot Encapsulation (Isolation Voltage Capability) | 2500 | V |
| Thermal Protection Isolation Voltage Capability (when operated) | 600 | V |
| Insulation Resistance | 100 | MΩ |

Figure 4:
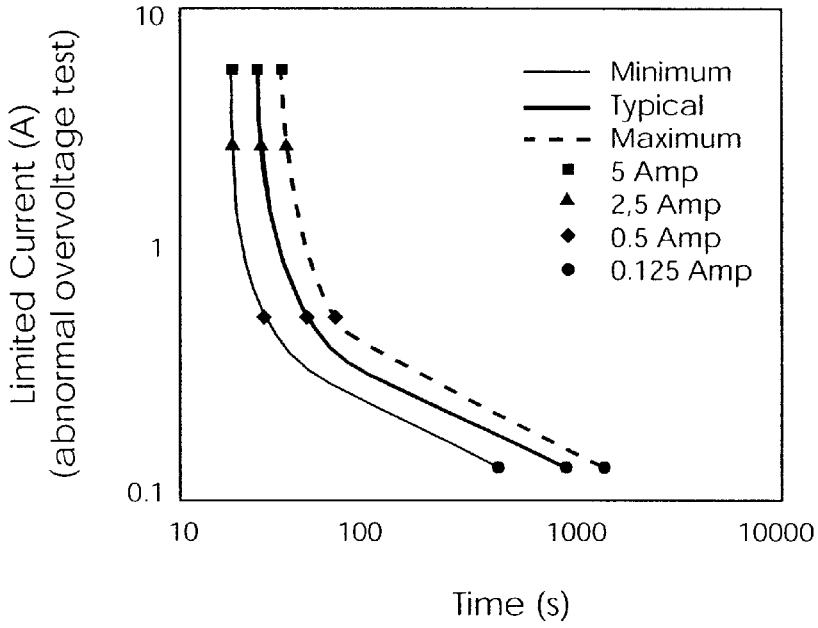
FIG. 4 illustrates four sets of times for fuse opening, one set for each of four limited current values.

The thermal characteristics are shown in FIG. 4 which illustrates the time to open circuit under abnormal over-voltage with limited current values as for FIG. 3.

The fuse 7 operates by the solder fillets 11 and 14, the link 10, and the hot melt 12 becoming molten due to sustained abnormal over-voltages. However, the link 10 is the primary active fuse element because it is of SnPb solder composition with a fluxed core. The flux causes it to form into a ball, pulling away from the electrode 6. The internal flux core causes the solder material of the link 10 to form into a sphere, with the flux causing the solder to wet to itself. Surface tension is also an important aspect of the action to withdraw into a sphere. It is allowed to do so as the solder fillet 11 also melts. At the same time, the hot melt 12 rapidly fills the emerging gap between the material of the link 10 and the electrode 6. This action is particularly quick because the hot melt 12 is already in contact with the electrode 6 and it is only required to spread across the face of the electrode as the link 10 melts and retracts away from the electrode surface. The insulative properties of the hot melt 12 ensure a very effective and substantial insulation gap between the lead 5 and the electrode 6 in a short time period as illustrated in FIG. 4.

The invention is not limited to the embodiments described herein but may be varied in construction and detail. For example, the varistor of the invention may additionally comprise a third lead connected to the electrode 6 via the low temperature solder fillet 11. If this solder flows, the third lead is electrically disconnected and a visual and/or audible indicator is activated. Also, the metal of the link 10 may have a different composition such as SnPbAg or SnPbBi or other similar compositions.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. A metal oxide varistor comprising:

a varistor body;

a plurality of electrodes on the varistor body, at least one electrode being a fused electrode;

a plurality of leads; and a fuse connecting at least one of the plurality of leads to the fused electrode, the fuse including an insulator overlying part of the fused electrode, a link having a portion overlying the insulator and a portion electrically connected to the fused electrode, the link being of a material having a melting point at or below a thermal safety temperature threshold for the varistor, and a body of hot melt material in contact with the link, the hot melt material being an electrical insulator and having a melting point such that it melts and flows to create an insulating gap between the fused electrode and the material of the link when the link becomes molten.

2. The metal oxide varistor as claimed in claim 1, wherein the link is of elongate wire shape.

3. The metal oxide varistor as claimed in claim 1, wherein the link comprises a solder material and internal flux within the solder material.

4. The metal oxide varistor as claimed in claim 3, wherein the solder material is Sn/Pb.

5. The metal oxide varistor as claimed in claim 3, wherein the flux is located centrally within the link.

6. The metal oxide varistor as claimed in claim 1, wherein the hot melt material surrounds the link between the insulator and the fused electrode.

7. The metal oxide varistor as claimed in claim 6, wherein the hot melt material is in contact with the fused electrode.

8. The metal oxide varistor as claimed in claim 7, wherein portion of the hot melt material lies between the fused electrode and the link.

9. The metal oxide varistor as claimed in claim 1, wherein the link is electrically connected to the fused electrode by a low temperature solder fillet.

10. The metal oxide varistor as claimed in claim 1, wherein the hot melt material acts to retain the link in position, so that the link has a stable position before encapsulation.

11. A metal oxide varistor comprising:

a varistor body;

a plurality of electrodes on the varistor body, at least one electrode being a fused electrode;

a plurality of leads; and a thermal fuse connecting one of the plurality of leads to the fused electrode, the fuse further including an insulator overlying part of the fused electrode and a link of elongate shape and having flux surrounded by solder material having a melting point at or below a thermal safety temperature threshold for the varistor, the link including a first portion in contact with the fused electrode, a second portion surrounded by a body of hot melt material, said hot melt material also being in contact with the fused electrode, and a third portion overlying the insulator and being connected to a lead, wherein said hot melt material is an electrical insulator and has a melting point such that it melts and flows to create an insulating gap between the fused electrode and the material of the link when the link becomes molten.

12. A fuse integrated in a metal oxide varistor, wherein the varistor includes a varistor body, a plurality of electrodes with at least one electrode being a fused electrode, and a plurality of leads, the fuse connecting at least one lead to the fused electrode, the fuse comprising:

an insulator overlying part of the fused electrode;

a link having a portion overlying the insulator and a portion electrically connected to the fused electrode, the link being of a material having a melting point at or below a thermal safety temperature threshold for the varistor; and a body of hot melt material in contact with the link, the hot melt material being an electrical insulator and having a melting point such that it melts and flows to create an insulating gap between the fused electrode and the material of the link when the link becomes molten.

13. A fuse integrated in a metal oxide varistor, wherein the varistor includes a varistor body, a plurality of electrodes with at least one electrode being a fused electrode, a plurality of leads, the fuse connecting at least one lead to the fused electrode, the fuse comprising:

an insulator overlying part of the fused electrode; and a link of elongate shape and including flux surrounded by solder material having a melting point at or below a thermal safety temperature threshold for the varistor, the link further including a first portion in contact with the fused electrode, a second portion surrounded by a body of hot melt material, said hot melt material also being in contact with the fused electrode, and a third portion overlying the insulator and being connected to a lead, wherein said hot melt material is an electrical insulator having a melting point such that it melts and flows to create an insulating gap between the fused electrode and the material of the link when the link becomes molten.

* * * * *